US005325151A

United States Patent [19]

Kimura et al.

[11] Patent Number: 5,325,151

[45] Date of Patent: Jun. 28, 1994

[54] REVOLVER TYPE DEVELOPING DEVICE FOR AN IMAGE FORMING APPARATUS

[75] Inventors: Noriyuki Kimura, Kawasaki; Minoru Suzuki, Yokohama, both of Japan

[73] Assignee: Ricoh Company, Ltd., Tokyo, Japan

[21] Appl. No.: 19,563

[22] Filed: Feb. 18, 1993

[30] Foreign Application Priority Data

Feb. 27, 1992 [JP] Japan ..... 4-041082

[51] Int. Cl.[5] ..... G03G 15/01

[52] U.S. Cl. ..... 355/200; 355/245; 355/326 R; 118/645; 346/157

[58] Field of Search ..... 118/645, 653; 355/326, 355/327, 245, 259, 200; 346/157

[56] References Cited

U.S. PATENT DOCUMENTS

| | | | |
|---|---|---|---|
| 3,987,756 | 10/1976 | Katayama et al. . | |
| 4,615,612 | 10/1986 | Ohno et al. . | |
| 4,697,915 | 10/1987 | Hayashi et al. . | |
| 4,713,673 | 12/1987 | Kessoku . | |
| 4,728,987 | 3/1988 | Diola et al. . | |
| 4,733,267 | 3/1988 | Enoki et al. . | |
| 4,743,938 | 5/1988 | Ohno . | |
| 4,922,301 | 5/1990 | Katoh et al. | 355/251 |
| 5,168,319 | 12/1992 | Kimura et al. | 355/326 R |
| 5,198,866 | 3/1993 | Kimura et al. | 355/326 R |
| 5,258,819 | 11/1993 | Kimura et al. | 355/326 R |

FOREIGN PATENT DOCUMENTS

| | | | |
|---|---|---|---|
| 60-239770 | 11/1985 | Japan | 355/327 |
| 63-316068 | 12/1988 | Japan | 355/327 |
| 4-198962 | 7/1992 | Japan | 355/327 |

*Primary Examiner*—R. L. Moses

*Attorney, Agent, or Firm*—Oblon, Spivak, McClelland, Maier & Neustadt

[57] ABSTRACT

A revolver type developing device for an image forming apparatus. A rotary body is mounted on a shaft and has a plurality of developing units mounted thereon. The developing units are arranged around the shaft, and each stores a powdery developer and accommodates a developer transport member for supplying the developer to an image carrier. A drive source rotates the rotary body to bring any one of the developing units to a developing position where the developing unit faces the image carrier. A one-way transmission mechanism is located on a drive transmission path extending from the drive source to the rotary body for preventing a drive force from being imparted from the rotary body to the drive source. When the rotary body tends to rotate or vibrate due to an external force or vibration, the rotation or vibration is prevented from reaching the drive source.

3 Claims, 9 Drawing Sheets

REVOLVER TYPE DEVELOPING DEVICE FOR AN IMAGE FORMING APPARATUS

BACKGROUND OF THE INVENTION

The present invention relates to a revolver type developing device for a copier, laser printer, facsimile transceiver or similar image forming apparatus.

Conventional image forming apparatuses include a full color copier which exposes a photoconductive element or similar image carrier to color-separated light images to electrostatically form corresponding latent images, develops each of the latent images by a toner of complementary color, and transfers the resulting toner images to a single recording medium one above the other. A multicolor image forming apparatus is also conventional which sequentially exposes an image carrier to images to be reproduced in different colors, develops each of the resulting images by a developer of particular color to produce a corresponding toner image, and transfers such toner images to a single recording medium. This kind of image forming apparatuses need a plurality of developing units. However, a plurality of developing units constructed independently of each other and arranged around the image carrier would increase the overall size of the apparatus. A revolver type or rotary type developing device which is a recent achievement can eliminate this problem. The revolver type developing device, or simply revolver as referred to hereinafter, has a rotatable cylindrical casing located to face an image carrier, and a plurality of developing units disposed in the casing and supported in predetermined positions. The developing units are sequentially brought to a developing position to develop latent images by respective toners.

A prerequisite with the revolver type developing device is that a developer transport member accommodated in each developing unit and implemented as a roller or a sleeve be accurately positioned and fixed in a predetermined position in a developing region where it faces an image carrier. To meet this requirement, a groove may be formed in the outer periphery of the casing or rotary body and receive a pin, roller or similar stop provided at the outside of the casing, as disclosed in Japanese Patent Laid-Open Publication Nos. 3162/1986 and 78175/1988 by way of example. However, the problem with this kind of scheme is that the force restricting the position of the casing is not sufficient in the direction in which a spring for absorbing the inertial rotation of the casing expands or in the direction in which the casing rotates for the replacement of a color. Hence, when an external force or vibration acts on the casing, the casing is apt to rotate or vibrate away from the predetermined position. Further, a solenoid or similar extra mechanism, part and operation control are necessary for the stop to be released from the groove before the start of color replacement.

To position and fix the casing in the predetermined position, a pin movable perpendicularly to the end of the casing may be used and selectively inserted into a hole formed in the end of the casing, as taught in Japanese Patent Laid-Open Publication No. 65276/1986. However, this approach is not practicable unless the positional accuracy of the pin and hole is extremely high and without resorting to a solenoid or similar extra part for moving the pin. Moreover, to insert the pin into the hole which rotates together with the casing, extremely complicated control is needed over the rotation of the casing.

In the light of the above, a stepping motor or pulse motor may be used as an exclusive drive source for the casing or rotary body. Then, the casing will be positioned and fixed by the position control and holding ability of the motor itself. Alternatively, braking means may be associated with an exclusive motor for holding the casing at the predetermined position. A problem with these schemes is that a current has to be continuously fed while the casing is held in the predetermined position. Another problem is that a large size motor is needed to exert a sufficient holding force on the casing. As a result, the device generates heat, consumes disproportionate power, and increases the cost.

SUMMARY OF THE INVENTION

It is, therefore, an object of the present invention to provide a revolver type developing device for an image forming apparatus which can surely and accurately position and fix a rotary body thereof with a simple construction.

A revolver type developing device for an image forming apparatus of the present invention comprises a rotary body rotatable about a shaft, a plurality of developing units mounted on the rotary body around the shaft and each storing a powdery developer and accommodating a developer transport member for supplying the powdery developer to an image carrier, a drive source for rotating the rotary body to bring any one of the plurality of developing units to a developing position where the developing unit faces the image carrier, and a one-way transmission mechanism located on a drive transmission path extending from the drive source to the rotary body for preventing a drive force from being imparted from the rotary body to the drive source.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
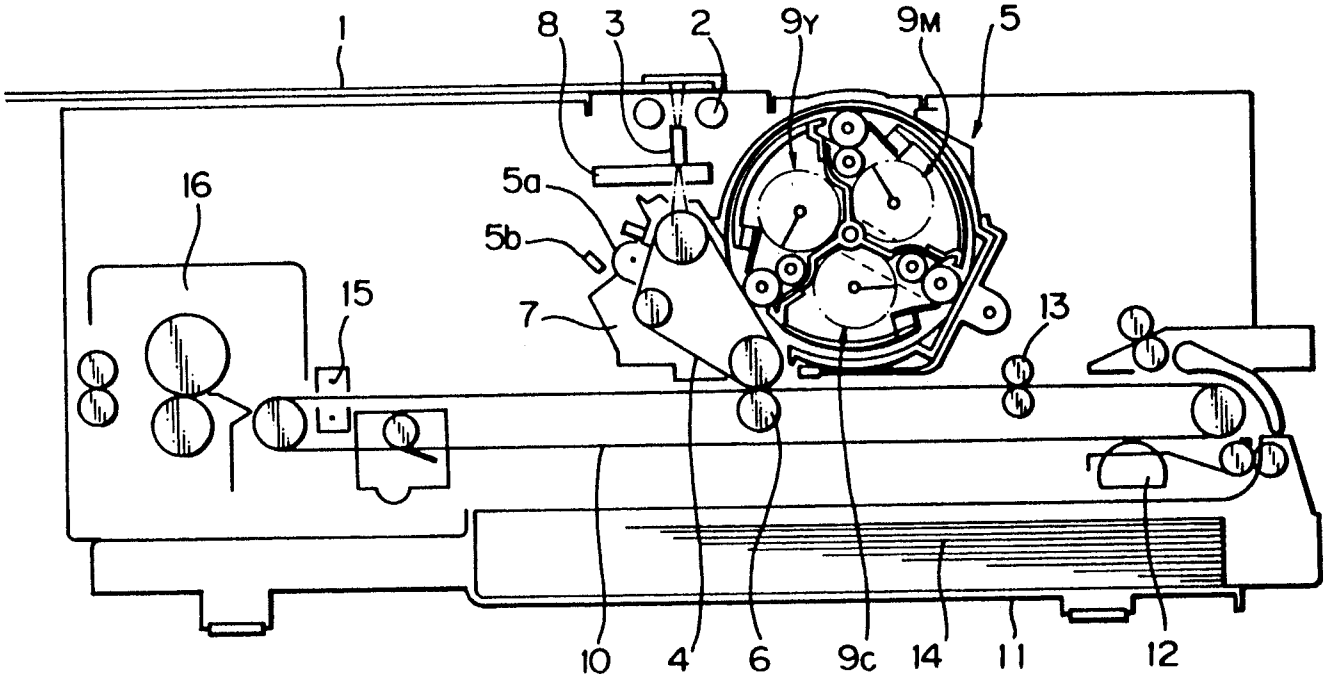
FIG. 1 is a front view of a full color copier to which a developing device embodying the present invention is applied.

Referring to FIG. 1 of the drawings, a full color copier implemented with a revolver type developing device embodying the present invention is shown. As shown, the copier has a glass platen 1 movable in the right-and-left direction as viewed in the figure. As the glass platen 1 is moved, a document laid on the glass platen 1 is illuminated by a lamp 2 through a slit at a predetermined position. The resulting reflection from the document is focused onto a photoconductive element, or image carrier, 4 via a rod lens array 3. In the embodiment, the photoconductive element 4 is implemented as a belt. At this instant, a subscan drive mechanism, not shown, moves the glass platen 1 and belt 4 in synchronism. Consequently, a latent image is electrostatically formed on the belt 4 having been uniformly charged by a charger 5*a*. A revolver type developing device, or simply revolver as often referred to hereinafter, 5, a transfer roller 6, a cleaning device 7 and a discharge lamp 5*b* are sequentially arranged around the belt 4 in a direction A indicated by an arrow in the figure. Filters 8 of three primary colors, i.e., blue, green and red are selectively located on the optical path for exposure. The latent images formed via the filters 8 are respectively developed by yellow, magenta and cyan developing units $9_Y$, $9_M$ and $9_C$ built in the revolver 5.

A transport belt 10 is disposed in an image transfer section and surrounds the transfer roller 6. A recording medium, e.g., a paper 14 is fed from a tray 11 by a pick-up roller 12 and driven to the belt 10 via a register roller 13. The belt 10 transports the paper 14 in a reciprocating motion in the horizontal direction while positively retaining it thereon. As a result, the toner images of three different colors are sequentially transferred to the paper 14 one above the other. The paper 14 carrying the resulting full-color image thereon is discharged by a discharger 15 together with the belt 10 to be thereby separated from the belt 10. After the image has been fixed on the paper 14 by a fixing device 16, the paper 14 is driven out of the copier as a full-color copy.

Figure 2:
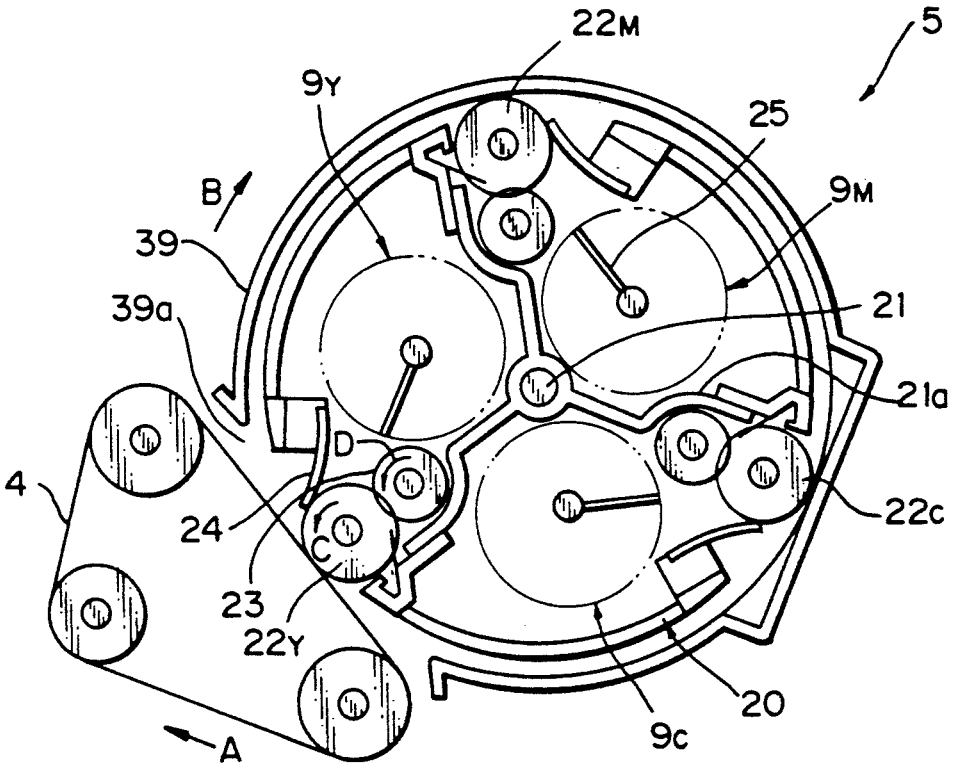
FIG. 2 is an enlarged section of the developing device included in the copier of FIG. 1.

FIG. 2 shows the revolver type developing device 5 in detail. As shown, the revolver 5 has a hollow cylindrical casing 20 rotatable about a rotary shaft 21. A drive transmission mechanism which will be describes causes the casing 20 to rotate in a direction indicated by an arrow B in the figure. Three partition plates 21*a* are disposed in the casing 20 and radially extend from the shaft 21. The previously mentioned developing units $9_Y$, $9_M$ and $9_C$ are defined by the partition plates 21*a*. In the specific condition shown in FIG. 2, the developing unit $9_Y$ is located at a developing position where it faces the belt 4. The developing units $9_Y$, $9_M$ and $9_C$ incorporate cylindrical developing rollers, or developer transport members, $22_Y$, $22_M$ and $22_C$, respectively. The developing rollers $22_Y$–$22_C$ are each partly exposed to the outside via an associated opening formed through the casing 20. The rollers $22_Y$–$22_C$ are rotatable in a direction C when driven by a drive transmission mechanism which will be described.

In the illustrative embodiment, the developing units $9_Y$, $9_M$ and $9_C$ store nonmagnetic single component type developers, i.e., a yellow toner, a magenta toner, and a cyan toner, respectively. The developing units $9_Y$–$9_C$ are selectively rotated about the shaft 21 to the developing position to sequentially develop the latent images electrostatically formed on the belt 4. The resulting toner images of different colors are sequentially transferred to the paper 14 to form a composite full color image.

A cylindrical toner supply roller 23 is pressed against each of the developing rollers 22 and made of foam polyurethane or similar elastic material. The supply roller 23 is rotated in a direction D by a drive transmission mechanism which will be described to supply the toner to the associated developing roller 22 while charging it by friction. A blade 24 is also made of urethane rubber or similar elastic material and located downstream of the supply roller 23 with respect to the direction of rotation of the developing roller 22. One edge of the blade 24 is pressed against the developing roller 22 to regulate the thickness of the toner deposited on the roller 22. Further, an agitator 25 is disposed in each of the developing units $9_Y$–$9_C$ and driven at an adequate timing by a drive mechanism, not shown.

Figure 3:
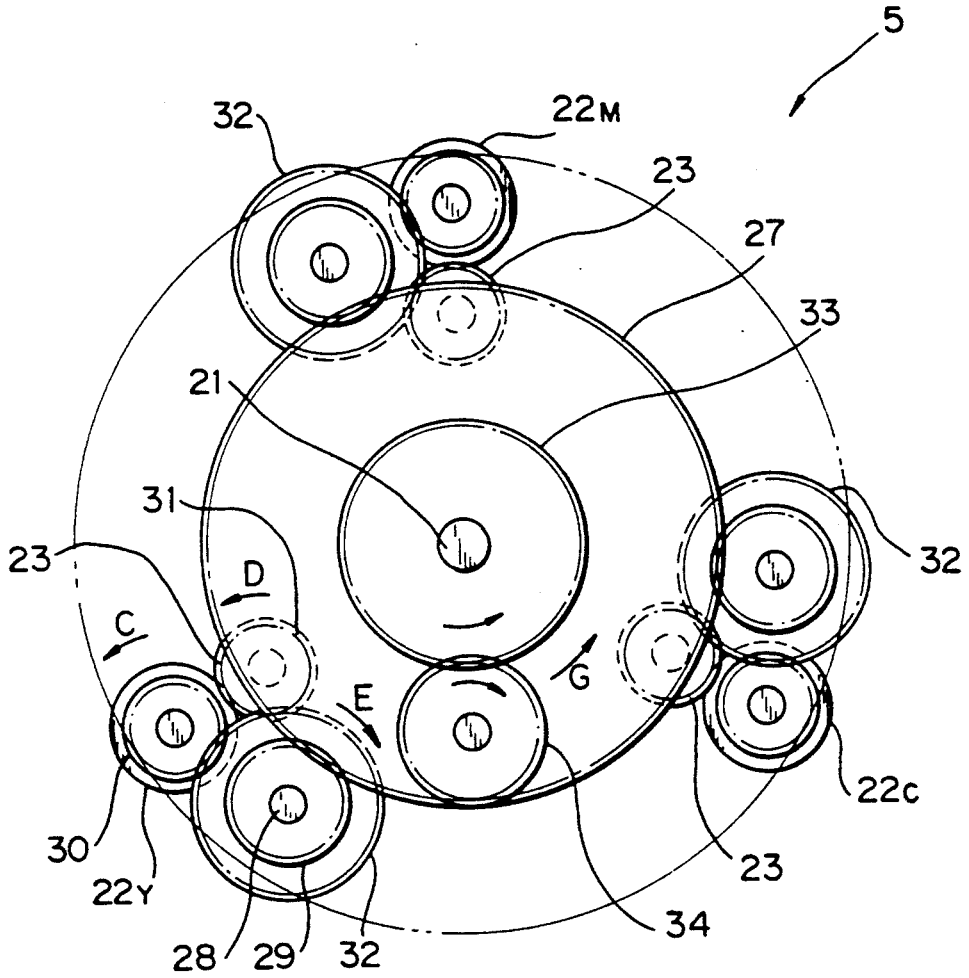
FIG. 3 is a section showing a drive transmission mechanism for the developing device.
Figure 4:
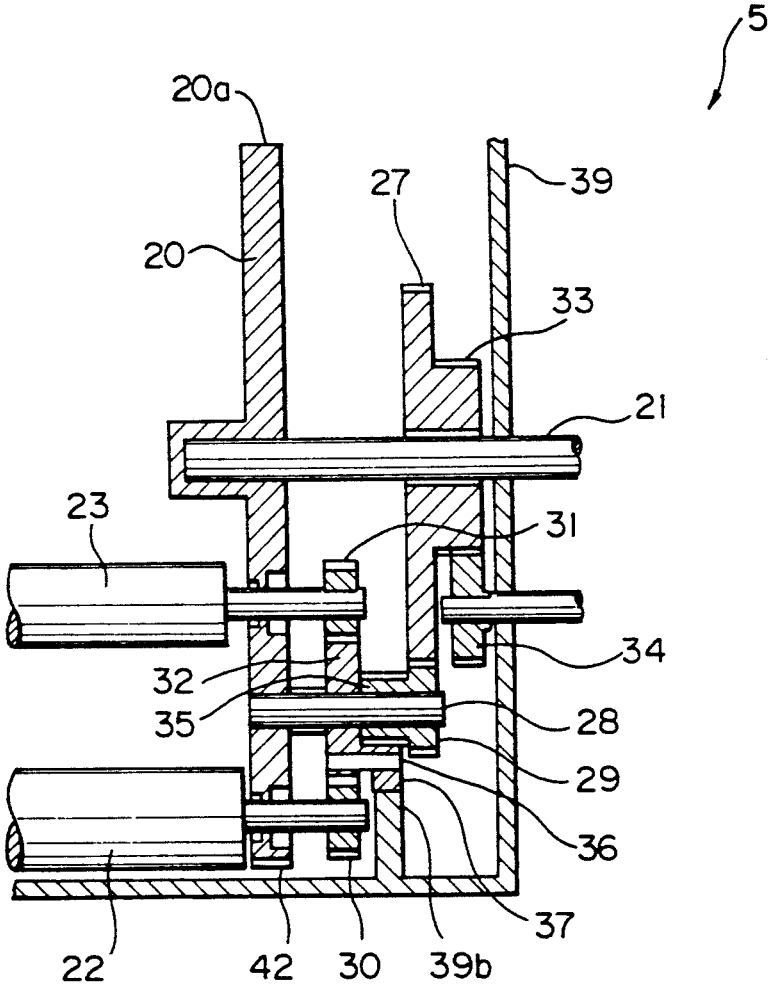
FIG. 4 is a fragmentary section of the drive transmission mechanism.

A reference will be made to FIGS. 3, 4, 5A and 5B for describing a mechanism for driving the developing device 5. As shown in FIGS. 3 and 4, a sun gear 27 is mounted coaxially with the shaft 21 of the revolver 5 and rotatable relative to the shaft 21 and a side wall 20*a* which forms part of the casing 20. Shafts 28 are affixed to the side wall 20*a* in one-to-one correspondence with the developing units $9_Y$–$9_C$. A planetary gear or idler gear 29 is rotatably mounted on the fixed shaft 28 and held in mesh with the sun gear 27. Gears 30 and 31 are respectively mounted on the shaft of the developing roller 22 and the shaft of the supply roller 23. A clutch gear 32 is rotatably mounted on the fixed shaft 28 and meshed with the gears 30 and 31.

A gear 33 having a comparatively small diameter is formed integrally with the sun gear 27 and meshed with a gear 34. While development is under way, the gear 34 is rotated by a drive source, not shown, mounted on the copier body to in turn rotate the sun gear 27 and idler gears 29 at a constant rate. A drum portion 35 is formed integrally with each idler gear 29 and provided with a ratchet teeth in the form of projections or recesses on the outer periphery thereof. A pin 36 is studded on each clutch gear 32 while a pawl 37 is rotatably supported by the pin 36. A torsion coil spring or similar biasing means, not shown, constantly biases the pawl 37 in a direction indicated by an arrow F in FIG. 5B.

Figure 5A:
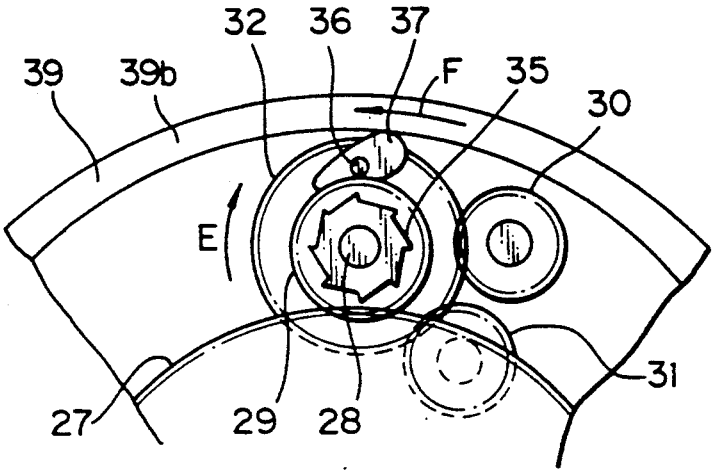
FIGS. 5A and 5B are sections showing the coupling and uncoupling operations of the drive transmission mechanism.
Figure 5B:
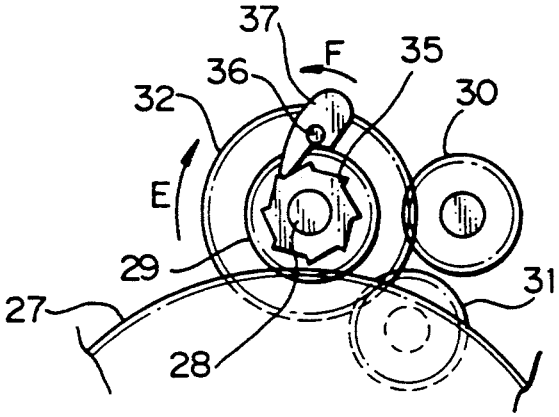
Figure 6:
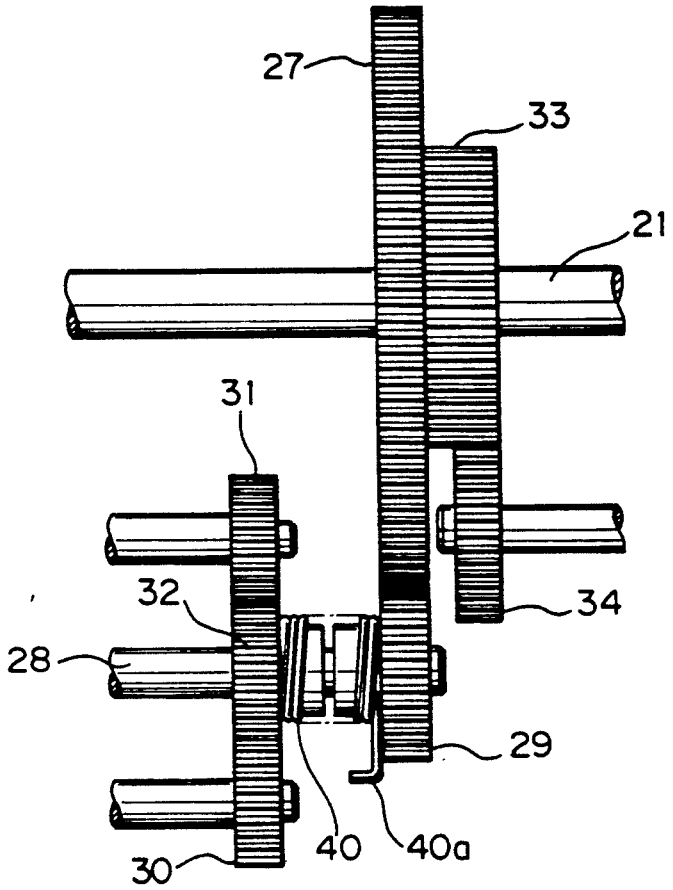
FIG. 6 is a side elevation showing a modified form of a clutch mechanism.
Figure 7:
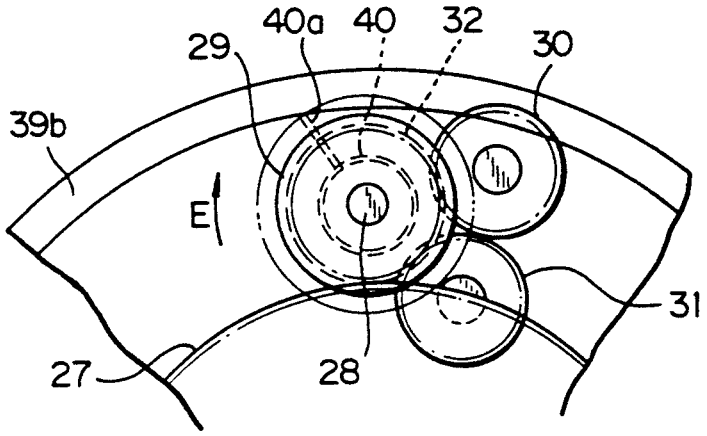
FIG. 7 is a section demonstrating the coupling and uncoupling operations of the clutch mechanism of FIG. 6.
Figure 8A:
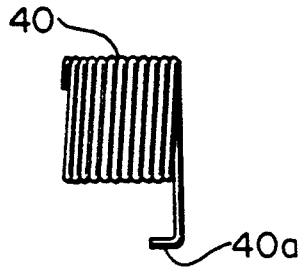
FIGS. 8A and 8B are views showing a coil spring.
Figure 8B:
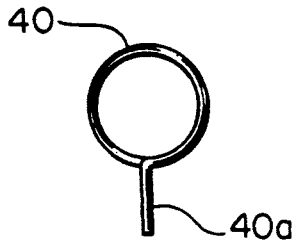

A cylindrical cover 39 covers the revolver 5 and has an opening 39*a*, FIG. 2, in part thereof. A projection 39*b* is provided on the inner periphery of the cover 39 to extend along the circumference of the cover 39. Assume that any one of the developing units $9_Y$–$9_C$ is located in a position other than the developing position. Then, the pawl 37 of the developing unit 9 is restrained by the projection 39*b* at the rear end thereof. Hence, as shown in FIG. 5A, a protuberance extending from the front end of the pawl 37 of the developing unit of interest is released from the projection 39*b* due to the opening 39*a* of the cover 39. As a result, the pawl 37 is rotated about the pin 36 in the direction F and brought into mesh with the ratchet teeth of the drum 35, as shown in FIG. 5B. The pawl 37, therefore, starts rotating in a direction E together with the idler gear 29. It follows that in the developing position the developing roller 22 and supply roller 23 are rotated to develop a latent image formed on the belt 4.

After such a sequence of image forming steps has been completed, the drive of the copier body for development is interrupted to stop the operation of the developing units $9_Y$–$9_C$.

FIGS. 6, 7, 8A and 8B show another specific clutch mechanism which is implemented as a so-called spring clutch mechanism. As shown, the idler gear 29 meshing with the sun gear 27 and the gear 32 meshing with the gears 30 and 31 are provided with drum portions which face each other. A torsion coil spring 40 is loaded between the drum portions of the gears 29 and 32. The coil spring 40 has an arm 40*a* at one end thereof. While development is not under way, the arm 40*a* is restrained by the projection 39*b* of the cover 39, as in the previous arrangement. This restraint acts in a direction for loosening the coil spring 40 with the result that the idler gear 29 simply idles. Hence, the driving force is not transmitted to the developing roller 22 and supply roller 23. As the associated developing unit 9 is brought to the developing position by the revolver 5, the arm 40*a* of the coil spring 40 is released from the projection 39*b* of the cover. Consequently, the rotation of the idler gear 29 is transferred to the developing roller 22 and supply roller 23 via the gear 32.

As stated above, the illustrative embodiment has a mechanical clutch structure capable of transmitting a driving force only in one direction. Hence, even when a force acts on, for example, the sun gear 27 in a direction opposite to expected one, it is not transferred to the developing roller 22. This prevents the toner from being scattered around and protects the developing unit from damage ascribable to the reverse rotation of the developing roller 22. It is to be noted that the clutch configurations described above are only illustrative and not limitative.

Further, in the embodiment, the member for restricting the drive transfer to the clutch is implemented as the circumferential projection 39*b* formed integrally with the cover 39. However, such a restricting member may alternatively be mounted on the side wall of the copier body, if necessary. In addition, the clutch mechanism may be directly mounted on the shaft of the developing roller 22 or that of the supply roller 23.

In the embodiment, the drive transfer is effected by the clutch mechanism while the gear associated with the clutch is held in mesh in a predetermined manner at all times. This is successful in eliminating incomplete mesh, vibration, noise and damage of the gear otherwise occurring on the replacement of the developing unit. Since the developing roller 22 is driven only at the predetermined developing position (and in close proximity thereto), the toner is prevented from being scattered around at the other positions. Moreover, since only one of the developing units is driven at a time, an excessive drive torque is not needed. In addition, the service life of the developing units is increased since they are free from loads when located at positions other than the developing position.

Furthermore, since the drive transfer is selectively effected by the mechanical clutch and since the developing device is loaded with a simple and reliable drive mechanism, the drive mechanism to be mounted on the copier body can be simplified and reduced in size without substantially increasing the size of the developing device. The drive mechanism does not rely on an electromagnetic clutch, solenoid or similar electric part. This kind of mechanism is inexpensive and resistive to noise.

The mechanical clutch transmits a driving force in only one direction, as stated earlier. Hence, even when a force acts on, for example, the sun gear 27 in a reserve direction due to a motor error or an externally derived force, it is not transmitted to the belt 4. This is also successful in preventing the toner from being scattered around and in protecting the developing unit from damage ascribable to the reverse rotation of the developing roller 22. The developing unit (developing roller) is constantly driven throughout the image forming operation (i.e. from the start to the end of printing) and, therefore, does not need any control in the event of replacement of the unit. In addition, since extra periods of time are not needed at the time of starting up and ending the developing roller drive, enhancing rapid image formation.

Figure 9:
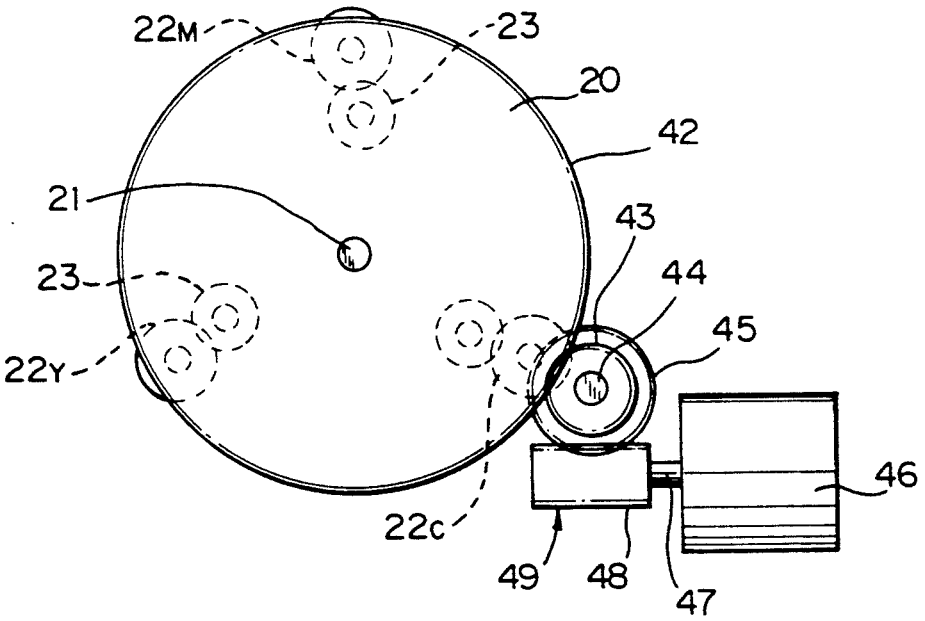
FIG. 9 is a section showing a drive transmission system for a rotary body.
Figure 10:
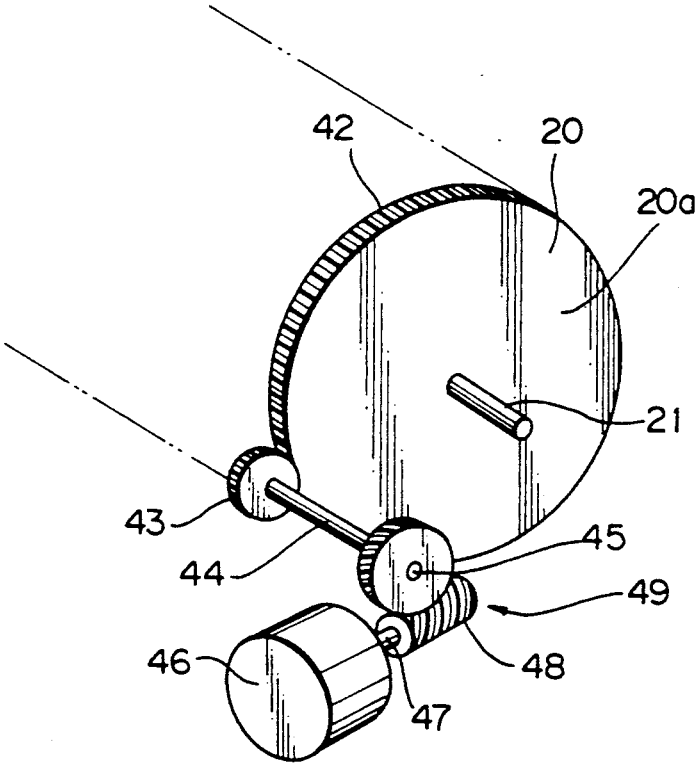
FIG. 10 is a perspective view associated with FIG. 9.
Figure 11:
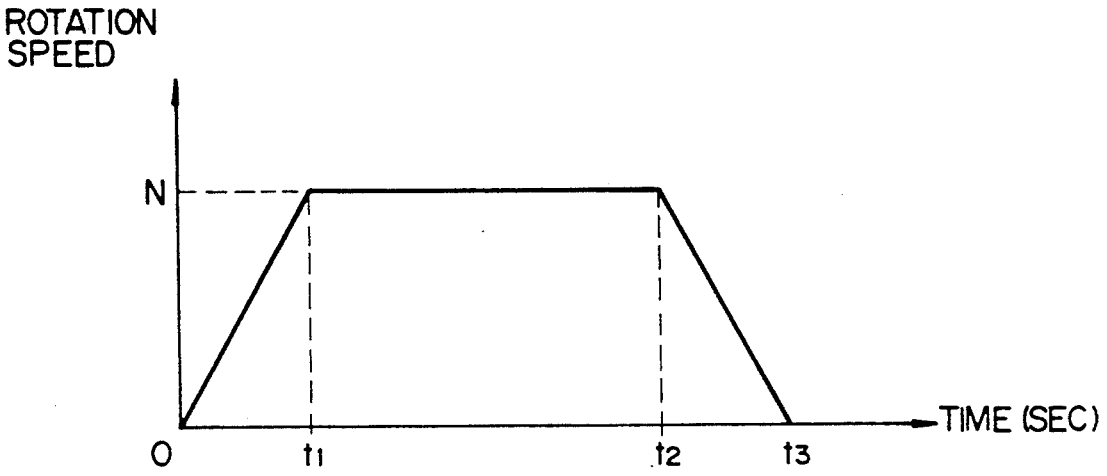
FIG. 11 is a graph representative of specific control over the rotation speed of a stepping motor.

Referring to FIGS. 9, 10 and 11, the essential features of the illustrative embodiment will be described. The casing or rotary body 20 (side wall 20*a*) is formed with a gear 42 on the entire outer circumference thereof (see FIG. 4). A drive gear 43 is mounted on a shaft 44 and held in mesh with the gear 42. The shaft 44 is journalled to the copier body via bearings, not shown. A worm wheel 45 is also mounted on the shaft 44. A stepping motor or pulse motor 46 plays a role of a drive source for the developing device. A worm 48 is mounted on the output shaft 47 of the motor 46 and held in mesh with the worm wheel 45. The worm 48 and worm wheel 45 constitute a one-way transmission mechanism 49 on the drive transmission path. In the embodiment, the worm 48 has a single thread and a lead angle of about 3 degrees while the worm wheel 45 has thirty teeth. The circumferential gear 42 of the side wall 20*a* are each implemented as a helical gear having a helix angle of 20 degrees. The gears 42 and 43 have 120 teeth and twenty teeth, respectively. The distance between the axes of the gears and the accuracy of teeth are so controlled as to reduce the backlash between the gears.

In the embodiment, the interior of the rotary body is partitioned into three developing units 9Y, 9M and 9C each accommodating the developing roller 22, as stated earlier. Specifically, to replace the color for development, the revolver 5 is usually rotated by 120 degrees and then brought to a stop as soon as a particular developing roller 22 faces the belt 4. It follows that to select the next color for development, the revolver 5 rotates an angle corresponding to forty teeth of the circumferential gear 42, i.e., the stepping motor 46 rotates sixty rotations within a predetermined period of time.

The stepping motor 46 is deenergized on rotating a predetermined number of rotations (number of pulses). At this instant, a drive force is acting on the developing roller 22 due to the previously stated clutch mechanism. Therefore, a force tending to rotate the revolver 5 in a direction G acts between the gears 33 and 34, FIG. 3. However, in the embodiment, the worm 48 and worm wheel 45 are located on the drive transmission path extending from the motor 46. As a result, such a rotational force is prevented from being imparted from the revolver 5 to the motor 46 due to the relation between the lead angle and the helix angle. Specifically, when the motor 46 is simply deenergized, the rotation of the revolver 5 about the shaft 21 is restricted, i.e., the revolver 5 is accurately positioned and fixed. Since the worm 48 and worm wheel 45 allow the rotation speed of the rotary body or casing 20 to be reduced in a considerable ratio to the rotation speed of the output shaft 47 of the motor 46, the motor 46 itself is used in a high speed and highly efficient range. Therefore, not only a miniature motor suffices, but also a speed reducer does not have to be associated with the motor.

Although a force ascribable to the inertia of the revolver 5 itself acts at the time of start and end of rotation of the revolver 5, it is also absorbed by the construction described above. In addition, the stepping motor 46 facilitates the control over the rotation speed of the rotary body to thereby insure smooth rotation of the rotary body.

FIG. 11 shows specific control over the rotation speed of the stepping motor 46. As shown, a slow-up (acceleration) and a slow-down (deceleration) range are respectively provided immediately after the start of rotation and immediately before end end of rotation. This is successful in reducing the influence of the inertia at the time of start and stop of rotation of the rotary body.

Figure 12:
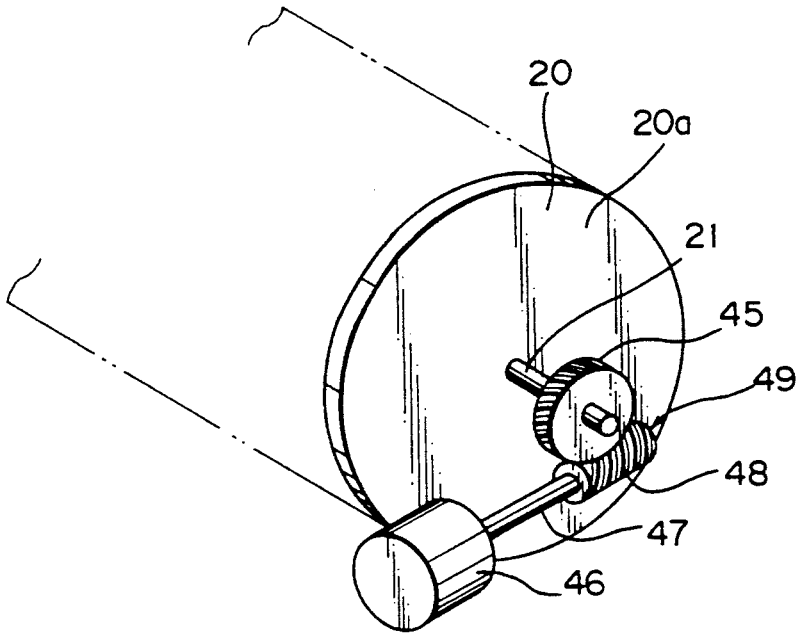
FIG. 12 is a perspective view of a modified form of the drive system for the rotary body.

FIG. 12 shows a modified form of the above construction. As shown, the worm wheel 45 is mounted on the shaft 21 of the revolver 5 and directly meshes with the worm 48 mounted on the output shaft 47 of the motor 46. Such an arrangement reduces the backlash between the gears to a considerable degree. This further promotes the accurate positioning of the revolver 5 and eliminates even fine vibration of the revolver 5 otherwise occurring when the developing roller 22 is driven.

In summary, in accordance with the present invention, on a drive transmission path extending from a drive source which rotates a rotary body accommodating a plurality of developing units, a one-way transmission mechanism is located which transmits rotation from the drive source to the rotary body, but not from the rotary body to the drive source. Hence, when the rotary body tends to rotate or vibrate due to an externally derived force or vibration, the one-way transmission mechanism prevents the rotation or vibration from being imparted to the drive source. It follows that when the drive source is simply deenergized, the movement of the rotary body is restricted. Specifically, the rotation of the rotary body about a shaft can be restricted to insure the positioning of the rotary body relative to an image carrier without resorting to a complicated drive and positioning mechanism and parts or a complicated control system. Particularly, when the one-way drive transmission to the rotary body is implemented with a worm and worm wheel device, the rotation speed of the rotary body can be reduced in a considerable ratio to the rotation speed of the drive source. This allows the drive source itself to be used in a high-speed and highly efficient range, promoting the use of a miniature motor.

Various modifications will become possible for those skilled in the art after receiving the teachings of the present disclosure without departing from the scope thereof.

What is claimed is:

1. A revolver type developing device for an image forming apparatus, comprising:

a rotary body rotatable about a shaft;

a plurality of developing units mounted on said rotary body around said shaft and each storing a powdery developer and accommodating a developer transport member for supplying said powdery developer to an image carrier;

a drive source for rotating said rotary body to bring any one of said plurality of developing units to a developing position where the developing unit faces the image carrier; and a one-way transmission mechanism located on a drive transmission path extending from said drive source to said rotary body for preventing a drive force from being imparted from said rotary body to said drive source.

2. A device as claimed in claim 1, wherein said one-way transmission mechanism comprises a worm and a worm wheel meshing with said worm.

3. A device as claimed in claim 2, wherein said worm is operatively connected to said drive source.

* * * * *